United States Patent [19]

Taniguchi et al.

[11] Patent Number: 4,876,481

[45] Date of Patent: Oct. 24, 1989

[54] ELECTROLUMINESCENT ELEMENT

[75] Inventors: Yuji Taniguchi, Furukawa; Masaru Banju, Miyagi, both of Japan

[73] Assignee: Alps Electric Co., Ltd., Japan

[21] Appl. No.: 228,665

[22] Filed: Aug. 4, 1988

[30] Foreign Application Priority Data

Nov. 30, 1987 [JP] Japan ..... 62-180992[U]

[51] Int. Cl.[4] ..... H01J 1/62

[52] U.S. Cl. ..... 313/502; 313/506; 313/509

[58] Field of Search ..... 313/502, 506, 509

[56] References Cited

U.S. PATENT DOCUMENTS 3,783,022 12/1974 Ueda ..... 313/502 X
4,417,174 11/1983 Kamijo et al. ..... 313/502
4,560,902 12/1985 Kardon ..... 313/502
4,585,673 4/1986 Sigai ..... 427/213

*Primary Examiner*—Donald J. Yusko
*Assistant Examiner*—Sandra L. O'Shea
*Attorney, Agent, or Firm*—Guy W. Shoup; Paul J. Winters

[57] ABSTRACT

There is disclosed an electroluminescent element which glows brightly and retains its high luminance over a long period of time. It is characterized in that the phosphor layer contains a cyanoethyl resin as the binder resin and the dielectric layer contains a powder of ferroelectric substance dispersed in a floroplastic as the binder resin. The dielectric layer contains as the binder resin a mixture of a fluoroplastic which is solid at normal temperature and a fluoroplastic which is liquid at normal temperature.

6 Claims, 1 Drawing Sheet

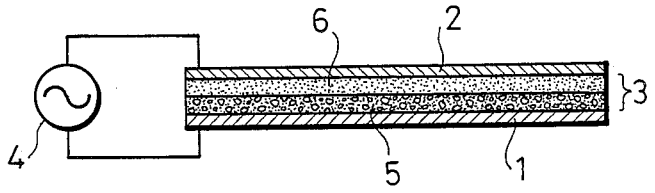
6
2
3
4
5
1

ELECTROLUMINESCENT ELEMENT

BACKGROUND OF THE INVENTION

1. Field of the Invention

The present invention relates to an electroluminescent element which consists of a transparent electrode and an opposed electrode, with a luminous layer interposed between them, so that application of an electric field across the two electrodes causes the luminous layer to glow.

2. Description of the Prior Art

Electroluminescent elements have been widely used as display elements and backlight of display devices for various kinds of machines and equipment. The electroluminescent element consists of a transparent electrode and an opposed electrode, with a luminous layer interposed between them, so that application of an electric field across the two electrode causes the luminous layer to glow. The luminous layer is made up of a phosphor layer formed by dispersing phosphor powder into a binder resin and a dielectric layer formed by mixing a highly dielectric fine powder (e.g., ceramics powder) into a highly dielectric binder resin.

The electroluminescent element constructed as mentioned above is produced in the following manner. At first, a phosphor paste is prepared by dispersing a phosphor powder into a solution of a binder resin in an organic solvent. This phosphor paste is applied onto a transparent electrode by screen printing or the like, followed by drying, to form a phosphor layer. Subsequently, a dielectric paste is prepared by dispersing a powder of ferroelectric substance (e.g., titanium oxide and barium titanate) into a solution of a binder resin in a solvent. This dielectric paste is applied onto said phosphor layer by screen printing or the like, followed by drying, to form a dielectric layer. Finally, a silver paste is applied onto said dielectric layer by printing technique to form an opposed electrode.

For an electroluminescent element to glow brightly, it is necessary that the phosphor layer have a high dielectric constant. To meet this requirement, it is necessary that the binder resin for the dielectric layer and phosphor layer have a high dielectric constant. An example of the binder resins having a high dielectric constant is a cyanoethyl resin such as cyanoethylcellulose. It is desirable for the improvement of luminance.

In the meantime, the phosphor powder in the phosphor layer should be protected certainly from moisture, because it is vulnerable to moisture and becomes deteriorated easily soon in a moist environment, greatly decreasing in luminance. For this reason, an electroluminescent element as a product is sealed in a sealing film; however, it is impossible to protect the phosphor powder completely from moisture by the sealing film. To supplement the insufficient moistureproofness of the sealing film, there has been proposed an idea of causing the binder resin to protect the phosphor powder from moisture. Unfortunately, the above-mentioned cyanoethyl resin is not desirable from the standpoint of moistureproofing function because it is poor is moisture resistance and gas barrier properties. Therefore, an electroluminescent element formed with cyanoethyl resin as the binder resin loses luminance in a short time when used in a high-temperature, high-moisture environment.

One binder resin desirable for protection of the phosphor powder from moisture is a fluoroplastic, which has superior moistureproofness and gas barrier properties. Unfortunately, a fluoroplastic resin does not increase luminance because it has a lower dielectric constant than a cyanoethyl resin. An additional disadvantage of a fluoroplastic is that it does not readily wet the phosphor powder and hence causes uneven glowing.

SUMMARY OF THE INVENTION

The present invention was made in order to eliminate the above-mentioned disadvantages. It is an object of the present invention to provide an electroluminescent element which glows brightly and retains its high luminance over a long period of time. The electroluminescent element of the present invention is characterized in that the phosphor layer contains a cyanoethyl resin as the binder resin and the dielectric layer contains a powder of ferroelectric substance dispersed in a fluoroplastic as the binder resin.

BRIEF DESCRIPTION OF THE DRAWINGS

The single drawing is a sectional view showing an embodiment of the electroluminescent element of the present invention.

DETAILED DESCRIPTION OF THE INVENTION

As mentioned above, according to the present invention, a cyanoethyl resin is used as the binder for the phosphor layer, and it increases the dielectric constant of the phosphor layer, which in turn leads to the improved luminance. In addition, according to the present invention, a fluoroplastic, which has a lower dielectric constant than a cyanoethyl resin, is used as the binder for the dielectric layer. Nevertheless, on account of the powder of ferroelectric substance dispersed therein, the dielectric layer has almost the same dielectric constant as the one containing a cyanoethyl resin would have. Therefore, the luminous layer as a whole has a high dielectric constant and glows brightly. In addition, the fluoroplastic used as a binder resin in the dielectric layer protects the phosphor powder from moisture on account of its good moistureproofness and gas barrier properties. Thus the electroluminescent element of the present invention has a long life and retains its high luminance over a long period of time.

EXAMPLE

The invention is now described in more detail with reference to the drawing, in which there are shown a transparent electrode 1, an opposed electrode 2, a luminous layer 3, a power source 4, a phosphor layer 5, and a dielectric layer 6. The luminous layer 3 is interposed between the transparent electrode 1 and the opposed electrode 2, and the power source 4 applies an AC electric field across the transparent electrode 1 and the opposed electrode 2 so as to cause the luminous layer 3 to glow. The luminous layer 3 is made up of the phosphor layer 5 formed on the transparent electrode 1 and the dielectric layer 6 formed on the opposed electrode 2.

The phosphor layer 5 is composed of a phosphor powder and a binder resin having a high dielectric constant. A preferred binder resin is a cyanoethyl resin such as cyanoethylcellulose and cyanoethylsaccharose. To form the phosphor layer 5, the binder resin is dissolved in a proper solvent to give a paste, which is then applied to the transparent electrode 1 by screen printing or the like, followed by drying.

The dielectric layer 6 is composed of a powder of ferroelectric substance such as titanium oxide and barium titanate and a binder resin. To form the dielectric layer 6, the mixture is dissolved in a proper solvent to give a paste, which is then applied onto the phosphor layer 5. In this way, there is obtained the luminous layer 4 composed of the phosphor layer 5 and the dielectric layer 6.

The binder resin for the dielectric layer 6 may be a fluoroplastic such as vinylidene fluoride, hexafluoropropylene, and vinylidene fluoride copolymer, and fluororubber, in place of the above-mentioned cyanoethyl resin. The fluoroplastic as the binder resin may be a solid one at normal temperature which is used alone, or a mixture of a solid one and a liquid one at normal temperature.

The paste to form the dielectric layer 6 may be composed of barium titanate and titanium oxide as the ferroelectric powder, a mixture of solid fluororubber (G501 made by Daikin Co., Ltd.) and liquid fluororubber (G101 made by Daikin Co., Ltd.) as the binder resin, and isophorone as the solvent. The preferred mixing ratio (by weight) is 10~25 for barium titanate, 10~25 for titanium oxide, 8 for fluororubber G501, 1~5 for fluororubber G101, and 20~40 for isophorone.

As mentioned above, the phosphor layer 5 contains cyanoethyl resin as the binder resin which has a high dielectric constant, and the dielectric layer 6 contains fluoroplastic as the binder resin which has a comparatively low dielectric constant. However, since a powder of ferroelectric substance is dispersed in the binder, the luminous layer 4 as a whole has a high dielectric constant and hence glows brightly. In addition, the phosphor layer 5 is covered with the dielectric layer 6 which contains fluororesin as the binder resin which has good gas barrier properties. Therefore, the phosphor powder contained in the phosphor layer 5 is protected from moisture by this dielectric layer 6. This ensures the prolonged life of the element even in a high-temperature, high-moisture environment.

The fluoroplastic used as the binder resin for the dielectric layer 6 should preferably be a mixture of a fluoroplastic which is solid at normal temperature and a fluoroplastic which is liquid at normal temperature. This is necessary to reduce the cohesive force of the binder resin so that the dielectric layer 6 wets readily the phosphor layer 5, without forming pinholes and other defects. Otherwise, the paste of dielectric substance does not get intimate with the phosphor layer 5 when applied onto it, because fluoroplastic is poor in wettability. On account of this binder composition, the luminous layer glows uniformly.

According to the present invention, the dielectric layer contains fluoroplastic as the binder resin which has good moistureproofness and gas barrier properties and the phosphor layer contains a cyanoethyl resin as the binder resin which has a high dielectric constant. Therefore, the luminous layer as a whole has a high dielectric constant and hence glows brightly. In addition, the phosphor powder in the phosphor layer is protected from moisture, which leads to the prolonged life of the element.

What is claimed is:

1. An electroluminescent element comprising:

a transparent electrode, an opposed electrode, and a luminous layer interposed between said transparent electrode and said opposed electrode, said luminous layer being composed of a phosphor layer and a dielectric layer, so that application of an electric field across the two electrodes causes the luminous layer to glow, wherein said phosphor layer contains a cyanoethyl resin as the binder resin and said dielectric layer contains a powder of ferroelectric substance dispersed in a mixture of two fluoroplastics, a first of which is solid at normal temperature and a second of which is liquid at normal temperature.

2. An electroluminescent element comprising:

a luminous layer including a phosphor sublayer and a dielectric sublayer, the phosphor sublayer containing phosphor particles and a cyanoethyl resin for binding the phosphor particles;

the dielectric sublayer containing a mixture of first and second fluoroplastics, the first fluoroplastic being solid and the second fluoroplastic being liquid;

a ferroelectric substance dispersed in the fluoroplastic mixture;

a first electrode on one side of the luminous layer; and a second electrode on the opposite side of the luminous layer.

3. An electroluminescent element as in claim 2 wherein the first fluoroplastic is a solid fluororubber.

4. An electroluminescent element as in claim 2 wherein the second fluoroplastic is a liquid fluororubber.

5. An electroluminescent element as in claim 2 wherein the ferroelectric substance is composed of titanium oxide.

6. An electroluminescent element as in claim 2 wherein the ferroelectric substance is composed of barium titanate.

* * * * *